US005496136A

United States Patent [19]

Egan

[11] Patent Number: 5,496,136

[45] Date of Patent: Mar. 5, 1996

[54] AUTOMATIC BUOYANCY COMPENSATOR WITH ELECTRONIC VERTICAL MOTION

[76] Inventor: Mark P. Egan, 8215 Walden Ave., Inyokern, Calif. 93527

[21] Appl. No.: 410,015

[22] Filed: Mar. 23, 1995

[51] Int. Cl.[6] ..... B63C 11/02

[52] U.S. Cl. ..... 405/186; 441/96

[58] Field of Search ..... 405/186, 193, 405/192; 441/92, 96

[56] References Cited

U.S. PATENT DOCUMENTS

| | | | |
|---|---|---|---|
| 3,487,647 | 1/1970 | Brecht | 61/69 |
| 3,820,348 | 6/1974 | Fast | 61/70 |
| 4,051,846 | 10/1977 | McClure, III | 405/186 X |
| 4,114,389 | 9/1978 | Bohmrich | 405/186 |
| 4,324,507 | 4/1982 | Harrah | 405/186 |
| 4,379,656 | 4/1983 | Darling | 405/186 |
| 4,437,843 | 3/1984 | Birle | 441/96 |
| 4,601,609 | 6/1986 | Hyde | 405/186 |
| 4,779,554 | 10/1988 | Courtney | 441/92 X |
| 4,964,404 | 10/1990 | Stone | 128/204.22 |
| 5,033,818 | 7/1991 | Barr | 350/174 |
| 5,049,864 | 9/1991 | Barshinger | 405/186 X |

FOREIGN PATENT DOCUMENTS

| | | | |
|---|---|---|---|
| 2551564 | 3/1985 | France | 405/186 |

*Primary Examiner*—Frank S. Tsay

[57] ABSTRACT

An improved buoyancy compensator that reduces the scuba diver's attention and exertion required for buoyancy control and vertical propulsion. The buoyancy compensator, which includes an electronic sensor/valve assembly and a flexible air bladder, automates and controls the vertical motion of the scuba diver. An embedded computer acquires pressure, temperature, and air flow sensor measurement data to determine the diver's vertical motion and the amount of the air in the bladder. The computer controls electronic fill and release valves to change the bladder air volume. Algorithms are implemented, by the computer, to automate controlled vertical propulsion for ascending and descending, neutral buoyancy maintenance, and surface operation. Automated transitions are provided between modes of operation and for a timed safety stop during the ascent from the dive.

12 Claims, 8 Drawing Sheets

AUTOMATIC BUOYANCY COMPENSATOR WITH ELECTRONIC VERTICAL MOTION

BACKGROUND OF THE INVENTION

1. Field of the Invention

The present invention relates to the motion control of scuba divers, particularly to buoyancy compensators which utilize flexible air bladders to provide control over the vertical motion of a scuba diver.

2. Description of the Prior Art

Buoyancy compensators are used by scuba divers to provide a means of controlling buoyancy while diving. Most, if not all, scuba divers currently use buoyancy compensators which consist of flexible air bladders and hand actuated pneumatic fill and release valves. The buoyancy force acting on the scuba diver is changed by adjusting the volume of air in the buoyancy compensator bladder.

The buoyancy compensators currently available to scuba divers require significant attention, from the diver, to attain and maintain neutral buoyancy, to safely descend, to safely ascend, and to establish adequate positive buoyancy at the surface. Tile diver controls buoyancy by using the hand actuated air valves to iteratively add and release air from the buoyancy-compensator bladder, while observing vertical motion changes by reference to nearby stationary objects or depth gauge readings. The diver also compensates for this coarse buoyancy control by swimming in the vertical direction opposite to the buoyancy force vector error.

Neutral buoyancy, attained by the method mentioned above, is achieved at a single depth and must be adjusted as the depth of the dive changes otherwise a deviation in the buoyancy force will develop. This deviation from neutral buoyancy is due to the volume of air in the bladder changing with changes in the hydrostatic pressure of the water, and thus with changes in the depth the diver. Since the air volume changes in a nonlinear fashion with depth, it is difficult to adjust for the buoyancy changes using hand actuated valves. It is desirable to avoid a negative buoyant condition since this can lead to inadvertent diver contact with fragile reef ecosystems or excessive dive depths. It is also desirable to avoid a positive buoyant condition since this requires the diver swim downward to maintain depth.

In the past, several Letters Patents of the United States have been granted on improvements to buoyancy compensators. The following patents claim to maintain neutral buoyancy as the scuba diver changes depth: 3,820,348 to Fast, 1974 Jun. 28; 4,114,389 to Bohmrich et al., 1978 Sep. 19; 4,324,507 to Harrah, 1982 Apr. 13; and 4,601,609 to Hyde, 1986 Jul. 22. These inventions are mechanical in nature and utilize springs, cables, and/or rigid volumetric structures to compensate for deviations from neutral buoyancy. Fast and Bohmrich utilize rigid outer shells for their buoyancy compensators, which are more unwieldy than the currently popular and streamlined flexible bladder designs. A limitation in utility of all of these buoyancy compensators is that the diver is required to first attain neutral buoyancy by the same iteration method mentioned above for currently available buoyancy compensators.

Another patent, 3,487,647 to Brecht, 1970 Jan. 6, provides the diver with a means to achieve neutral buoyancy by depression of a single button and then the rotation of a lever arm. This invention is a complex, mechanically controlled buoyancy compensator that includes: multiple pneumatic valves, springs, a bellows, a rocker arm, a rolling diaphragm, and a piston. Once neutral buoyancy is attained, the diver's vertical position is controlled, by the buoyancy compensator, so that a constant depth is maintained. A disadvantage of this buoyancy compensator is apparent when the diver tries to change depth while in the "constant depth" mode. Brecht's invention automatically changes the diver's buoyancy to maintain the same depth. For example, if the diver wishes to follow the top contour of a reef, then Brecht's invention would counter the diver's vertical motion, forcing the diver to remain at one depth.

One parameter that affects neutral buoyancy with depth changes is the compression and expansion of a diver's exposure suit. Only Fast and Harrah provide a means to compensate for this by including wet suit material inside the compensator mechanisms. A change in the thickness of the wet suit material inside the compensator mechanisms affects the amount of air added or released from the air bladders. Both compensation methods are coarse, at best, since the overall change in buoyancy force also depends on the area of the material used to for the exposure suit. The area of wet suit material depends on the size of the exposure suit as well as which components of the suit are actually being worn by the diver for the dive.

Another parameter that effects the buoyancy of the diver as the dive progresses is the amount of air consumed from the scuba tank. The weight of the air in the scuba tank at the start of the dive is approximately 6 pounds. As the dive progresses, the diver consumes air and the weight of the air in the scuba tank decreases, resulting in an increase in buoyancy. Brecht's invention, with the "constant depth" control mode, is the only prior-art buoyancy compensator which will compensate for the change in buoyancy due to the consumption of air in the scuba tank. But again, Brecht's buoyancy compensator forces the diver to remain at a constant depth.

During the descent of the dive, it is desirable to descend slowly to allow the air spaces in the body of the diver to equalize with the external hydrostatic pressure of the water. The scuba diver accomplishes this by first manually releasing; air from the buoyancy compensator to become negatively buoyant. As the diver descends, the descent rate is controlled by manually adding air to, and releasing air from, the buoyancy compensator, and by kicking upward toward the surface of the water. This manual control, with diver-sensed motion feedback, is required on currently available buoyancy compensators. The buoyancy compensators by Fast, Bohmrich et al., Harrah, and Hyde all provide buoyancy compensation with depth change but all of the prior-art references listed require thee diver's immediate attention to monitor the descent rate and to provide corrective actions, when necessary.

To ascend from a dive, the diver maintains a safe ascent rate by manually releasing air from the buoyancy compensator, while monitoring vertical velocity, and swimming toward the surface. Visual clues or depth gauge readings are used, by the diver, to estimate vertical velocity. Excessive ascent rates can lead to lung over-expansion injury and/or to decompression sickness. All currently available buoyancy compensators, as well as all of the prior art, require the diver's immediate attention and actions to monitor and control the ascent rate.

U.S. Pat. No. 4,437,843 to Birle, 1984 Mar. 20, provides a mechanical apparatus for limiting the ascent rate of an ascending diver. The utility of this invention is limited for vertical motion control, however, since the invention provides no means to support neutral buoyancy control or descent rate control.

A safety stop is routinely performed by scuba divers, during the final ascent from a dive, at a depth of approximately 15 feet. This safety stop provides a few more minutes to expire excess nitrogen from the diver's body, before surfacing. This is yet another precaution taken to avoid decompression sickness. No means is provided by prior art or currently available buoyancy compensators to automatically initiate the safety stop by stopping the diver's vertical motion and establishing neutral buoyancy at the safety stop depth.

Another function of the buoyancy compensator is to provide adequate positive buoyancy for the diver at the surface. This allows the diver to rest comfortably at the surface prior to and following the dive. Adequate positive buoyancy is obtained, by current buoyancy compensators and by prior art, using the hand actuated pneumatic valves to add air to the buoyancy compensator.

Scuba divers typically add weight to themselves, for example using a belt with lead weights, to provide sufficient negative buoyancy to allow them to sink from the surface while donning an empty buoyancy compensator and an exposure suit. It is desirable to use the minimum weight possible since this provides the best buoyancy control. More weight than necessary requires a larger air volume in the buoyancy compensator to balance the gravitational and buoyancy forces. The larger the air volume, the more the buoyancy force changes with depth, and the more difficult it becomes to compensate for it using hand actuated valves. The tendency, however, is to dive with more weight than is required to avoid the trial and error process of entering and exiting the water until the correct weight is determined. This further reduces the accuracy of buoyancy compensation using current buoyancy compensators.

SUMMARY OF INVENTION

It is a primary object of the present invention to provide a buoyancy control system that will significantly reduce the diver's attention and exertion required for buoyancy control during all phases of a scuba dive.

Another primary object is to provide a mechanically simple automatic buoyancy control device by implementing electronic control over the volume of air in a flexible air bladder.

A further object is to automate the process of attaining neutral buoyancy for the scuba diver and to automate the process for maintaining neutral buoyancy as the depth of the diver changes. This feature allows the diver to easily obtain neutral buoyancy and to move freely vertically and horizontally, with balanced buoyancy and gravitational forces. This feature minimizes inadvertent diver contact with delicate aquatic plant life caused by negative buoyancy force errors.

A further object is to provide an improved method for compensating for changes in the diver's exposure suit buoyancy due to changes in the hydrostatic pressure acting on the suit, thereby improving the accuracy of the neutral buoyancy control of the diver.

A further object is to provide a process for compensating for changes in buoyancy of the scuba tank as the air is consumed by the diver, thereby improving the accuracy of the neutral buoyancy control of the diver.

A further object is to provide automatic vertical propulsion and vertical velocity control of the diver during the descent of the dive. This feature allows the diver to concentrate on acclimatization to the increasing hydrostatic pressure of the surrounding water.

A further object is to provide automatic vertical propulsion and vertical velocity control of the diver during the ascent from the dive. This feature provides a method for transporting the diver to the surface which minimizes diver exertion and possible decompression sickness or lung overexpansion injury.

A further object is to automate the process of establishing adequate positive buoyancy at the surface prior to and following the dive. This feature minimizes diver exertion at the surface.

A further object is to provide an automatic, timed, safety stop prior to an automated final ascent to the surface. This function of the invention is a safety feature to further reduce the possibility of the diver developing decompression sickness.

A further object is to provide an automated transition from a controlled descent to the establishment of neutral buoyancy and vice versa. This feature provides a method to stop the diver's descent and obtain neutral buoyancy either at a predetermined depth or at the press of a button by the diver. This feature also allows the diver to continue to descend, from a neutral buoyancy state, by pressing a button.

A further object is to provide an automated transition from a controlled ascent to the establishment of neutral buoyancy and vice versa. This feature allows the diver to stop an ascent and obtain neutral buoyancy by the press of a button. Tills feature also allows the diver to continue to ascend, from a neutral buoyancy state, by pressing a button.

A further object is to provide the diver with a buoyancy compensator which does not require the diver to be as accurate at computing how much weight is required for optimum buoyancy control. This is accomplished through more accurate control of the volume of air in the buoyancy compensator.

A further object is to provide the diver with a simple interface to manually control the operation of the buoyancy compensator.

These and other objects and advantages are provided by the present invention, which automates the propulsion and control of the vertical motion of the scuba diver. The present invention accomplishes these objects by using an embedded control computer to electronically control the air volume in the buoyancy compensator. The invention includes a pressure sensor for measuring the hydrostatic pressure of the water, a temperature sensor to measure the temperature of the air in the buoyancy compensator, and air flow meters to measure the mass of air added and removed from the flexible air bladder. Also included in the invention are electronically controlled pneumatic fill and release valves to gate the flow of air in and out of the buoyancy compensator. A diver control panel is included for inputting pre-dive parameters, observing output status data, and for manually selecting the buoyancy compensator operation mode. The embedded control computer determines diver depth, vertical velocity, and vertical acceleration based on a series of pressure sensor measurements. The computer also determines the volume of the air in the buoyancy compensator bladder, based on air flow, temperature, and pressure measurement data. Algorithms in the computer provide for automated descent, ascent, neutral, and surface modes of operation. These modes of operation can be preprogrammed, or manually selected by the diver, using the diver control panel. Tabulated data on exposure suit component volume versus hydrostatic pressure and suit size are included in the embedded computer, to accurately compensate for changes in diver buoyancy due to exposure suit volume changes. Specific diver air consumption rates are computed and stored to accurately compensate for changes in the diver's buoyancy as air is consumed from the scuba tank.

BRIEF DESCRIPTION OF THE DRAWINGS

The features of the present invention will become apparent from the following detailed description of the invention when considered with the accompanying drawing figures, wherein.

DETAILED DESCRIPTION OF THE ILLUSTRATED EMBODIMENT

Figure 1:
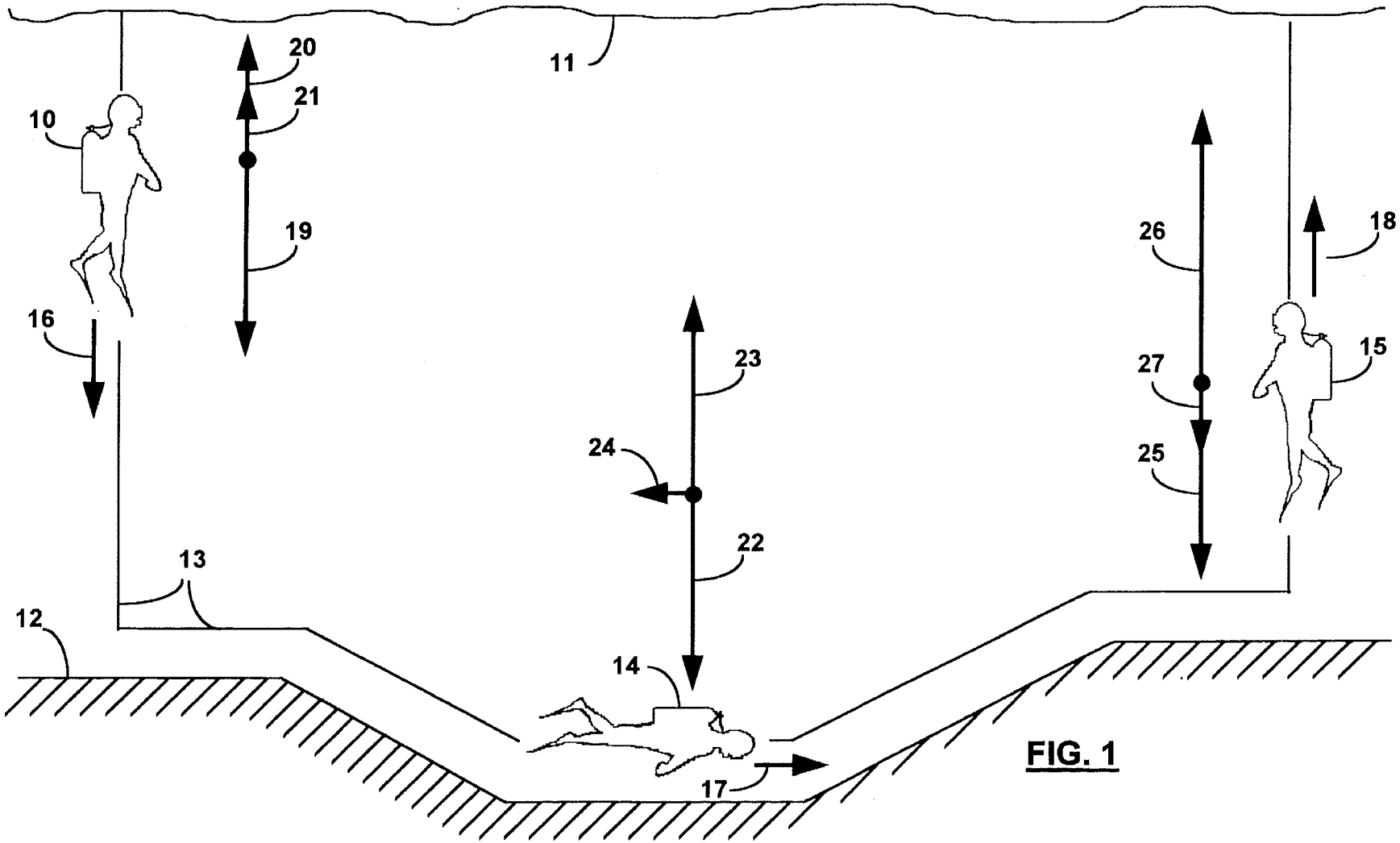
FIG. 1 is an diagrammatic elevation showing a representative operating environment for the invention.

The subject invention is best understood in relation to a representative operating environment shown in FIG. 1. A scuba diver 10 is submersed in a body of water 11, which is bounded below by an uneven bottom surface 12. The path of the diver during the dive is depicted by a series of connected lines 13. The three main phases of a scuba dive are depicted in this figure by the three illustrated positions of the scuba diver. The descent by the scuba diver is shown at position 10, the exploration phase of the dive is shown at diver position 14, and the final ascent from the dive is shown at diver position 15. The velocity of the diver at each illustrated position is represented by arrows 16, 17, and 18.

In the absence of water currents, the three main external forces acting on the diver are gravity, buoyancy, and drag. The force of gravity on the diver is represented by downward pointing arrows 19, 22, 25 at each diver position. The direction of the gravitational force, on the diver, remains unchanged throughout the dive. The magnitude of the gravitational force on the diver decreases as the mass of air in the scuba tank decreases. The buoyancy force vector is represented by arrows 20, 23, and 26 at each diver position. The direction of the buoyancy force vector is always opposite to the gravity force vector. The magnitude of the buoyancy force is equal to the weight of the volume of water displaced by the diver and equipment. For compressible objects, like the diver's buoyancy compensator and exposure suit, the buoyancy force decreases non-linearly with increasing depth. Tile buoyancy force is changed by adding and/or releasing air from the buoyancy compensator. The drag force on the diver is represented by arrows 21, 24, and 27 for each position of the diver. The direction of the drag vector is always opposite to the velocity vector of the diver. The magnitude of this force is a function of the velocity and drag characteristics of the diver. The net external force acting on the scuba diver is the vector sum of the gravity, buoyancy, and drag forces.

The present invention is a system for automatic vertical motion control which changes the air volume in the buoyancy compensator to control the net force on the scuba diver. The invention includes a process which automatically provides adequate positive buoyancy at the surface prior to and following the dive. The invention includes an automatic process to transition from a positive buoyant surface condition to a negative buoyant condition with constant descent velocity control as illustrated at diver position 10. The invention includes an automatic process to transition from a negative buoyant condition to a neutrally buoyant condition, at a predetermined depth. A process is provided to maintain neutral buoyancy with changes in depth, changes in diver's exposure suit volume, and changes in scuba tank buoyancy during the exploration phase of the dive as illustrated by diver position 14. The invention includes an automatic process to transition from a neutral buoyant condition to a positive buoyant condition with constant ascent velocity control as illustrated at diver position 15. The invention also includes a process for automatically implementing a safety stop, during the ascent phase of the dive, at a predetermined depth, for a predetermined amount of time.

Figure 2:
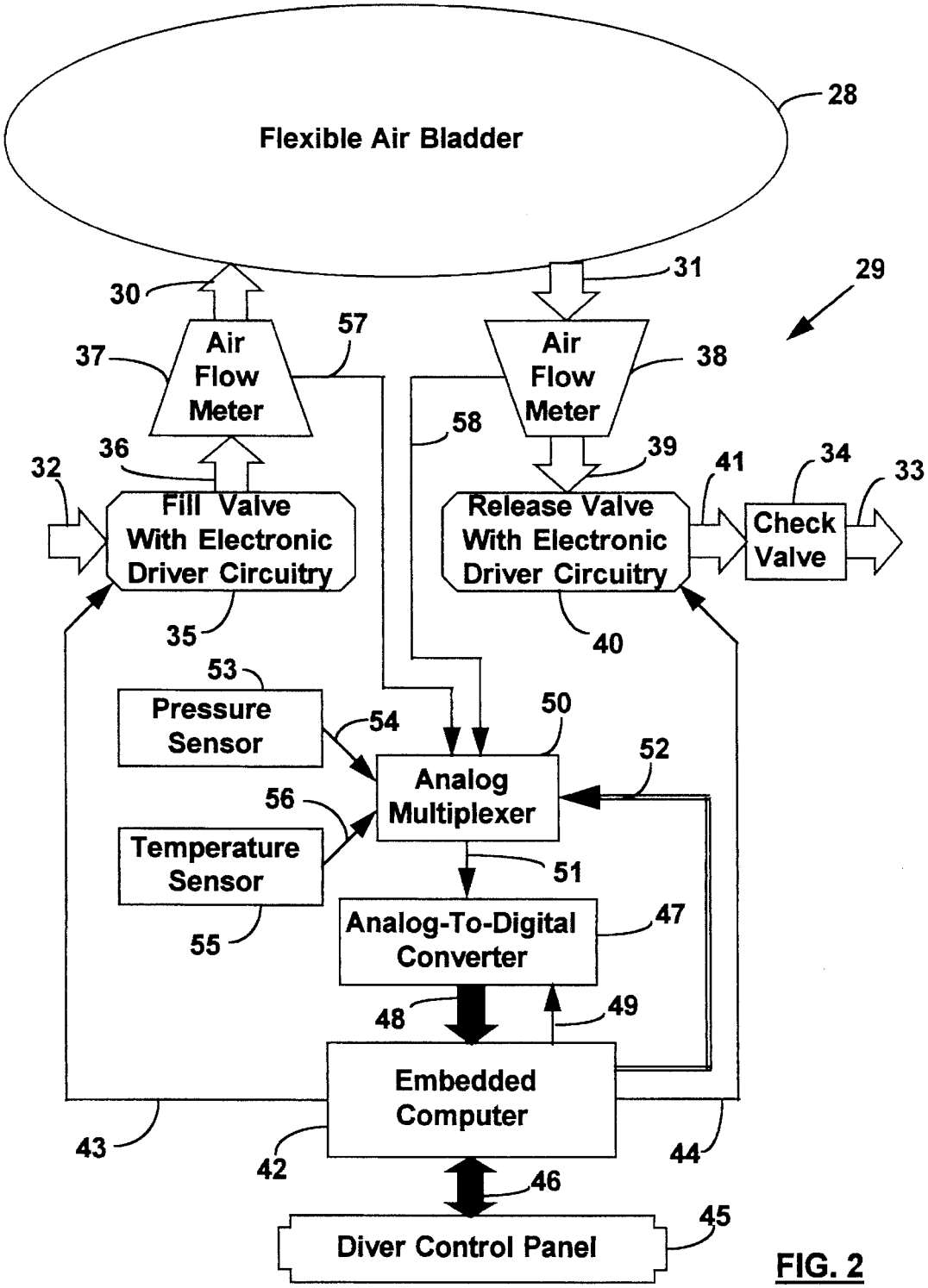
FIG. 2 is a block diagram of apparatus for practicing the invention.

A preferred embodiment of such a system representing the present invention is diagrammed in FIG. 2 and functions in accordance with a method of practicing the invention represented in FIGS. 3, 4, 5, 5A, 6 and 7.

FIG. 2 depicts an electronically controlled buoyancy compensator to provide automatic control over the vertical motion of a scuba diver. The electronically controlled buoyancy compensator includes an air bladder 28 and a control assembly, generally indicated as 29, which are coupled together in a suitable way, to provide fluid communication as indicated with arrows 30 and 31.

Bladder 28 is flexible such that when air is added to bladder 28 through coupling 30, the volume of water displaced increases. Also, when air is released from bladder 28 through coupling 31, the volume of water displaced decreases. Bladder 28 compresses and expands with changes in the hydrostatic pressure of the surrounding water. Bladder 28 is constructed of a suitably elastic material to provide a differential pressure of greater than 10 pounds per square inch between the air in bladder 28 and the surrounding water, at full inflation. The purpose for using elastic material for bladder 28 will be explained in a later paragraph.

Assembly 29 is suitably coupled to a conventional scuba tank regulator (not shown) to provide fluid communication between the conventional scuba tank (not shown) and assembly 29, as indicated by arrow 32. Assembly 29 is also coupled to a suitable vent passage (not shown) as indicated by arrow 33 for fluid communication with the surrounding water. A check valve 34 provides a discharge path for air out of assembly 29 and into the vent passage. Check valve 34 also blocks the flow of water into assembly 29 through coupling 33.

The conventional scuba tank regulator (not shown) is coupled to assembly 29 at the input of a fill valve 35. Fill valve 35 is any suitable valve that includes electronic driver circuitry such that the valve can be opened or closed, based on the state of an input digital signal. Fill valve 35 is normally closed when no electrical power is supplied to it. Fill valve 35 is utilized to gate the flow of air into bladder 28 which is supplied from the conventional scuba tank (not shown) at a regulated pressure of approximately 120 to 150 pounds per square inch. The pressure of the air in bladder 28 is a function of the depth of the diver and the tension of the stretched material of bladder 28. This air pressure remains less than 120 pounds per square inch at recreational scuba dive depths. For example, at a dive depth of 150 feet (beyond recreational depths) in the ocean, the hydrostatic pressure of the surrounding water is approximately 80 pounds per square inch. The output of fill valve 35 is coupled to the input of a fill gas flow meter 37, by a coupling 36, which provides fluid communication between the two components. Flow meter 37 is any suitable meter that provides an analog electrical output signal that is directly related to the sensed gas flow rate. The gas output of flow meter 37 is connected to bladder 28, by coupling 30, which provides fluid communication between flow meter 37 and bladder 28. Flow meter 37 is utilized to sense the amount of air added to bladder 28. The flow measurements made by flow meter 37 can be either a volumetric measurement or a mass flow measurement.

Bladder 28 is also in fluid communication with the input of a release gas flow meter 38 of assembly 29, by a coupling 31. Flow meter 38 is any suitable meter that provides an analog electrical output signal that is directly related to the sensed gas flow rate. Flow meter 38 is utilized to sense the amount of air released from bladder 28. The flow measurements made by flow meter 38 can be either a volumetric measurement or a mass flow measurement. The gas output of flow meter 38 is connected to the input of a release valve 40, by a coupling 39, which provides fluid communication between the two components. Release valve 40 is any suitable valve that includes electronic driver circuitry such that release valve 40 can be opened or closed based on the state of an input digital signal. Release valve 40 is normally closed when no electrical power is supplied to it. Tile output of release valve 40 is connected to check valve 34 by a coupling 41 which provides fluid communication between the two components. Release valve 40 is utilized to gate the flow of air from bladder 28 into the surrounding water. The net force on the air, in bladder 28, in the direction of release valve 40 is a function of the orientation of the buoyancy compensator, the volume of water displaced by the air, and the tension of the elastic bladder material of bladder 28. The elastic material of bladder 28 provides sufficient differential pressure between the air in bladder 28 and the surrounding water, such that air can escape from bladder 28, with any orientation of the scuba diver.

An embedded computer 42 is part of assembly 29 and is any suitable computer which has sufficient computing capacity and memory to implement the methods of operation shown in FIG. 3 through FIG. 7. Computer 42 has digital output ports to provide digital output high/low voltage levels. Computer 42 also has digital input ports to receive digital input high/low voltage levels.

Computer 42 is connected to fill valve 35 and release valve 40 by digital control lines 43 and 44 respectfully. The high/low voltage state of the signal from computer 42 on control line 43 dictates the open/closed state of fill valve 35. The high/low voltage state of the signal from computer 42 on control line 44 dictates the open/closed state of release valve 40.

The scuba diver can input information into computer 42 via a diver control panel 45 which is connected to computer 42 by a digital bus represented by a double arrow 46. Panel 45 provides an interface to input pre-dive information as well as manual selection of the dive mode during the dive. Panel 45 also displays dive output status information for the dive from computer 42, such as mode of operation, time elapsed, dive depth, and vertical velocity of the diver.

Computer 42 is also connected to an analog-to-digital converter 47 via a digital bus represented by arrow 48. Converter 47 is any suitable 8-bit analog-to-digital converter. The conversion input signal to converter 47 is provided by computer 42 via a control line 49.

The analog input signal to converter 47 is provided by an analog multiplexer 50 via a signal line 51. Multiplexer 50 is any suitable analog multiplexer that outputs one of four analog input signals to signal line 51. The signal to be output on signal line 51 is based on the state of 2 digital input control lines provided by computer 42, and represented by a double line arrow 52.

One of the input signals to multiplexer 50 is a signal provided by a pressure sensor 53 via a signal line 54. Sensor 53 is any suitable pressure sensor, with supporting circuitry, that provides an analog output voltage which is directly related to the hydrostatic pressure of the surrounding water.

A second signal provided to multiplexer 50 is a signal provided by a temperature sensor 55 via a signal line 56. Sensor 55 is any suitable temperature sensor, with supporting circuitry, that provides an analog output voltage which is directly related to the temperature of the air within bladder 28.

The remaining two signals provided to multiplexer 50 are provided by flow meters 37 and 38 via signal lines 57 and 58 respectfully. The input signal on signal line 57 is an analog voltage from flow meter 37 which is directly related to the amount of air flowing into bladder 28 from the scuba tank (not shown). The input signal on signal line 58 is an analog voltage from flow meter 38 which is directly related to the amount of air flowing out of bladder 28 and into the surrounding water.

The power source for the preferred embodiment of the invention is a conventional battery pack (not shown). The battery pack will provide a rechargeable feature and possesses sufficient energy storage capacity to support a minimum of three consecutive dives. The battery pack will be mounted on the buoyancy compensator harness (not shown) along with assembly 29.

METHODS OF OPERATION OF THE INVENTION

A brief description of how the diver operates the present invention will be provided now, followed by a detailed description of operation of the invention. Assembly 29 is first energized by the diver from panel 45. The diver enters specific dive parameters for use by computer 42 via panel 45 or allows previously stored parameters to be utilized. The diver dons the scuba tank (not shown), the present invention, and a weight belt (not shown). The weight belt has sufficient weight for the diver to be negatively buoyant when bladder 28 and the scuba tank are empty. Prior to entering the water, the diver verifies the present invention is initialized and ready for use by an audio/visual status indication from panel 45. The diver enters the water and is provided adequate positive buoyancy by the present invention to float comfortably at the surface of the water. When ready to descend, the diver presses the descend mode button on panel 45. The diver, as illustrated at position 10 of FIG. 1, descends at a slow velocity, propelled and controlled by the present invention. The present invention then automatically slows the diver to a stop and establishes neutral buoyancy at a preprogrammed depth, or after the diver presses the neutral mode control button on panel 45. Before exploring, the diver waits for an audio/visual indication from panel 45 that the present invention is calibrated for neutral buoyancy. The diver is then maintained in a state of neutral buoyancy as the diver explores, as illustrated by diver position 14 of FIG. 1. When the diver wishes to ascend to the surface, the diver presses the ascend mode button on panel 45. The diver, as illustrated at position 15 of FIG. 1, ascends at a slow velocity, propelled and controlled by the present invention. The present invention then automatically slows the diver to a stop and establishes neutral buoyancy at a preprogrammed depth for a safety stop time interval. Upon completion of the safety stop time interval, the present invention automatically propels the diver to the surface of the water at a slow, controlled velocity. The present invention then automatically provides adequate positive buoyancy for the diver to float comfortably at the surface. When ready, the diver exits the water. The dive is complete and the diver removes the equipment and de-energizes the present invention from panel 45.

The methods of operation of the present invention are illustrated using flow charts: FIGS. 3, 4, 5, 5A, 6, and 7. The function blocks in these figures are performed digitally by computer 42 (FIG. 2).

Figure 3:
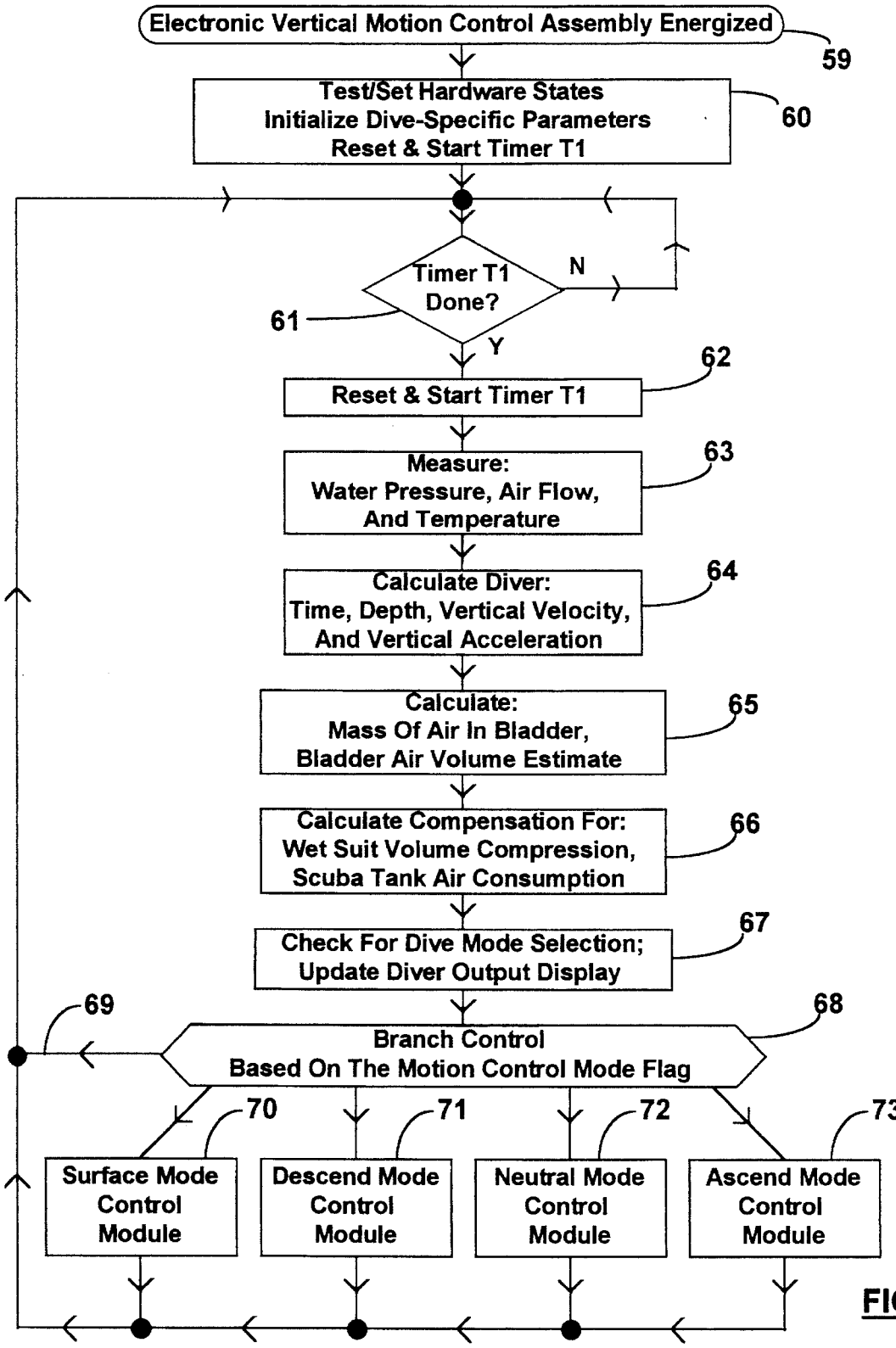
FIG. 3 is a top level flow chart representing a method of operation of the invention for automatic vertical motion control, during a scuba dive.

The flow chart in FIG. 3 summarizes the operation of the present invention. Block 59 of FIG. 3 represents the starting point of operation for the present invention, which begins when the diver energizes control assembly 29 from control panel 45.

At Block 60, the initialization of control assembly 29 takes place. Dive parameter values are loaded for the immediate dive, based on previously stored values and/or new inputs from the diver. The nature and purpose for these dive parameters will be explained in subsequent paragraphs. The initialization of a series of control flags also takes place at block 60. The main control flag is the motion control mode flag and it is initially set to surface mode. The control flags will be explained in the following paragraphs as they are utilized. Block 60 includes testing for hardware problems in control assembly 29. Block 60 also includes the resetting and starting of timer T1 which is used regulate the sample rate at which data is taken from flow meter 37, flow meter 38, pressure sensor 53, and temperature sensor 56. In the present embodiment of the invention, timer T1 is set to 100 milliseconds. Upon completion of block 60, processing flow enters a large loop that is iterated, with the 100 millisecond period of timer T1, until the control assembly 29 is de-energized.

Block 61 branches back to itself until timer T1 expires. Upon expiration of timer T1, block 61 branches to block 62. The purpose of block 61 is to maintain the sample period defined by timer T1. Block 62 resets and starts timer T1 for another cycle.

Block 63 represents the acquisition of all of the sensor data. Computer 42 sequentially sets multiplexer 50 and initiates conversions by converter 47 of pressure sensor 53 data, temperature sensor 55 data, flow meter 37 data, and flow meter 38 data, respectively. Look-up tables are used to convert the digital voltages from the respective sensors into the proper values for later computations.

Block 64 represents the computation of the current depth, vertical velocity, and vertical acceleration. All of these values are derived from current and previous pressure sensor 53 measurement data. These computations also depend upon the density of the water. The water density value, used for the computations, is based on the divers fresh water/salt water selection which is made prior to the dive at block 60. Block 64 also tracks and updates the diver's elapsed dive time. Another function of block 64 is to set the safety stop flag when a safety stop is recommended. This function includes a simple algorithm and a recreational dive table to track the residual nitrogen in the diver's body based on the diver's elapsed dive time and depth profile. A safety stop flag is set when the residual nitrogen level reaches the threshold where a safety stop is recommended by the dive table. This safety stop flag is later utilized to initiate a safety stop during the diver's ascent.

Block 65 represents the computations required to maintain an accurate estimate of the volume of air in bladder 28. These computations require the use of the current and previous measurements taken by sensors 53 and 55, and meters 37 and 38. The computations are based on conventional thermodynamic gas formulas that determine the volume of air in bladder 28 based on the mass of the air, the temperature of the air, and the pressure of the air. These formulas are well known and can be found in college physics and engineering text books.

Block 66 represents the computations that are made to compensate for the change in buoyancy caused by wet suit compression and the reduction of air mass in the scuba tank. The computation to estimate the change in wet suit buoyancy is based on the size, thickness, and type of exposure suit the diver is wearing, which is provided by the diver at block 60. The computation to estimate the change in air mass in the scuba tank is based on the current and previous pressure measurements from block 63 and diver-specific air consumption rate data, also provided by the diver at block 60.

After control assembly 29 is initialized in block 60, block 67 represents the data interface between the diver and computer 42. Computer 42 checks control panel 45 for a new dive mode selection. The dive mode selection can have one of five states: standby mode, surface mode, descend mode, neutral mode, or ascend mode. During initialization (Block 60), the motion control mode flag is set to surface mode. When a change in motion control mode is selected by the diver, from control panel 45, the motion control mode flag is updated. These modes of control will be discussed, in detail, in paragraphs that follow. Computer 42 outputs updated information to the control panel 45. This data includes elapsed dive time, the depth and velocity of the diver, and operational status information about the present invention.

Block 68 represents the branching of computer 42 operation based on the current state of the motion control mode flag. In the standby control mode, control is transferred to branch 69 which simply returns to block 61 with no change in the states of fill valve 35 and release valve 40. The remaining blocks: 70, 71, 72, and 73 each represent unique control modes of the present invention, and are expanded into more detail in flow charts: FIGS. 4, 5, 6, and 7, respectfully.

Figure 4:
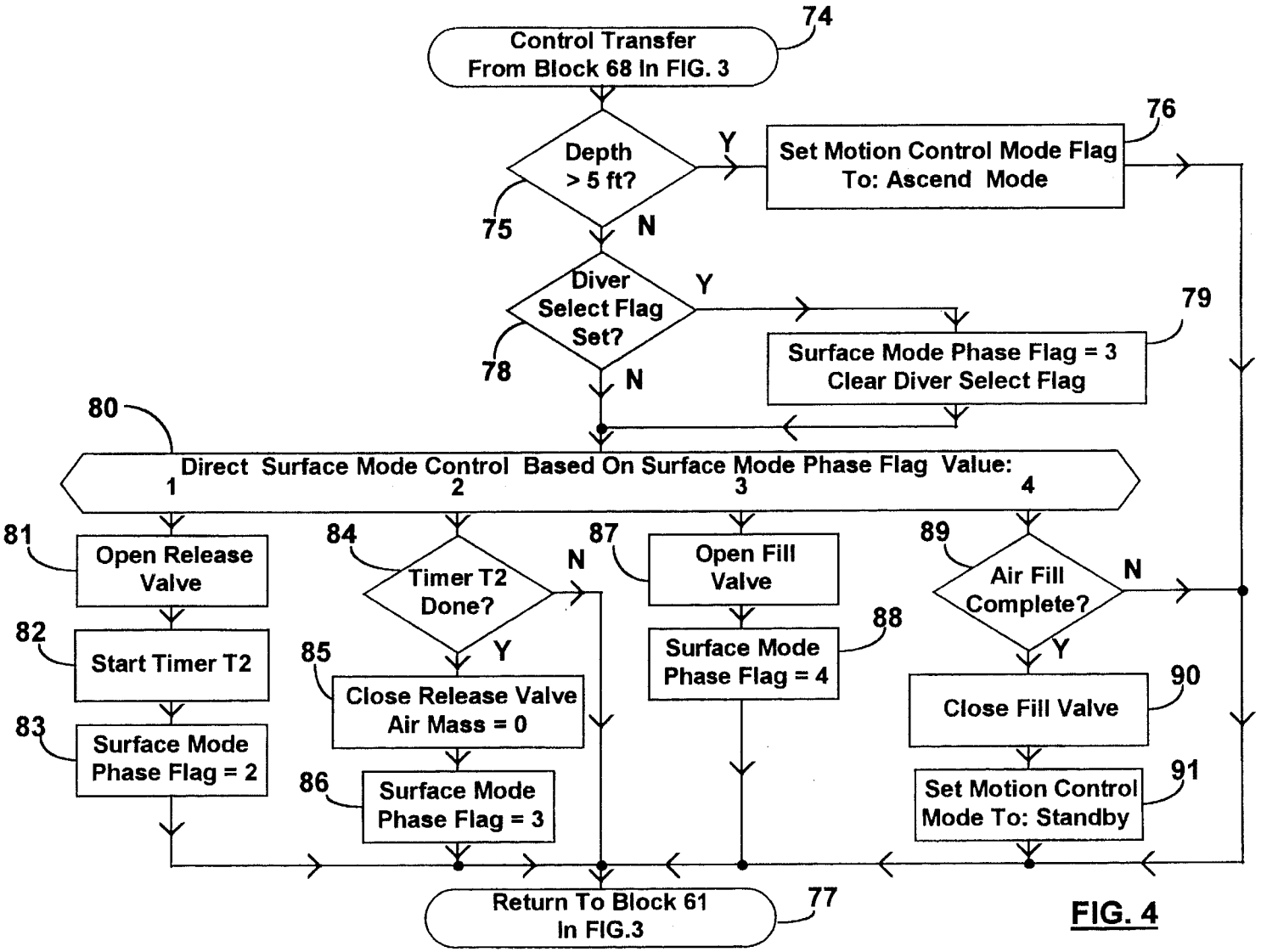
FIG. 4 is a flow chart representing a method of operation of the invention for automatic control of surface buoyancy.

Block 70 represents the surface mode of operation of the present invention and is shown in detail in FIG. 4. Block 74 of FIG. 4 simply represents the transfer of processing control from block 68 of FIG. 3.

Block 75 branches the processing based upon diver depth. If the diver presses the surface mode button at a depth of greater than 5 feet, then this block directs the processing control to block 76, which sets the motion control mode flag to ascend mode. The processing flow then passes to block 77, which returns control to block 61 of FIG. 3. This processing branch does not allow the diver to activate surface mode at depth greater than 5 feet.

Block 78 tests if the diver just selected surface control mode by testing the diver select flag that is set in block 67 of FIG. 3. If the diver select flag is set then processing control branches to block 79. The purpose of this branch is to set the surface mode phase flag value to bypass the process of initializing the volume of air in bladder 28, when surface mode is manually selected during the dive. Block 79 sets the surface mode phase flag to 3 and clears the diver select flag. Control is transferred to block 80.

Block 80 branches processing control, on each pass through the surface mode control module 70, based on the surface mode phase flag value. When the surface mode phase flag value is 1, processing control branches to block 81. The surface mode phase flag is set to 1 at block 60 during the initialization of control assembly 29.

Blocks 81, 82, and 83 start the initialization process of air bladder 28 and are only processed once during each use of the present invention. Block 81 opens release valve 40 to empty the air in bladder 28. Block 82 starts timer T2 which defines how long release valve 40 will remain open, and is sufficiently long to ensure that bladder 28 is purged of air. Block 83 sets the surface mode phase flag to 2 for the next pass through the surface mode control module. On the next pass through the surface mode control module, processing will branch from block 80 to block 84.

Block 84 tests if timer T2 is done. If timer T2 is done, blocks 85 and 86 are processed. Block 85 closes release valve 40 and sets the internal variable that represents the current mass of air in bladder 28 to zero. Block 86 sets the surface mode phase flag to 3 so that on the next pass through the surface control module, processing will branch from block 80 to block 87.

Block 87 opens fill valve 35 to start filling bladder 28 with a predefined amount of air to establish adequate positive buoyancy at the surface. Block 88 sets the surface mode phase flag to 4 so that on the next pass through the surface control module, processing will branch from block 80 to block 89.

When bladder 28 contains a predefined amount of air, block 89 branches processing to blocks 90 and 91. Block 90 closes fill valve 35. At this point in the process, air bladder 28 contains a measured amount of air which will provide adequate positive buoyancy for the diver at the surface. Surface control module processing is complete. Block 91 sets the motion control mode flag to standby mode.

Figure 5:
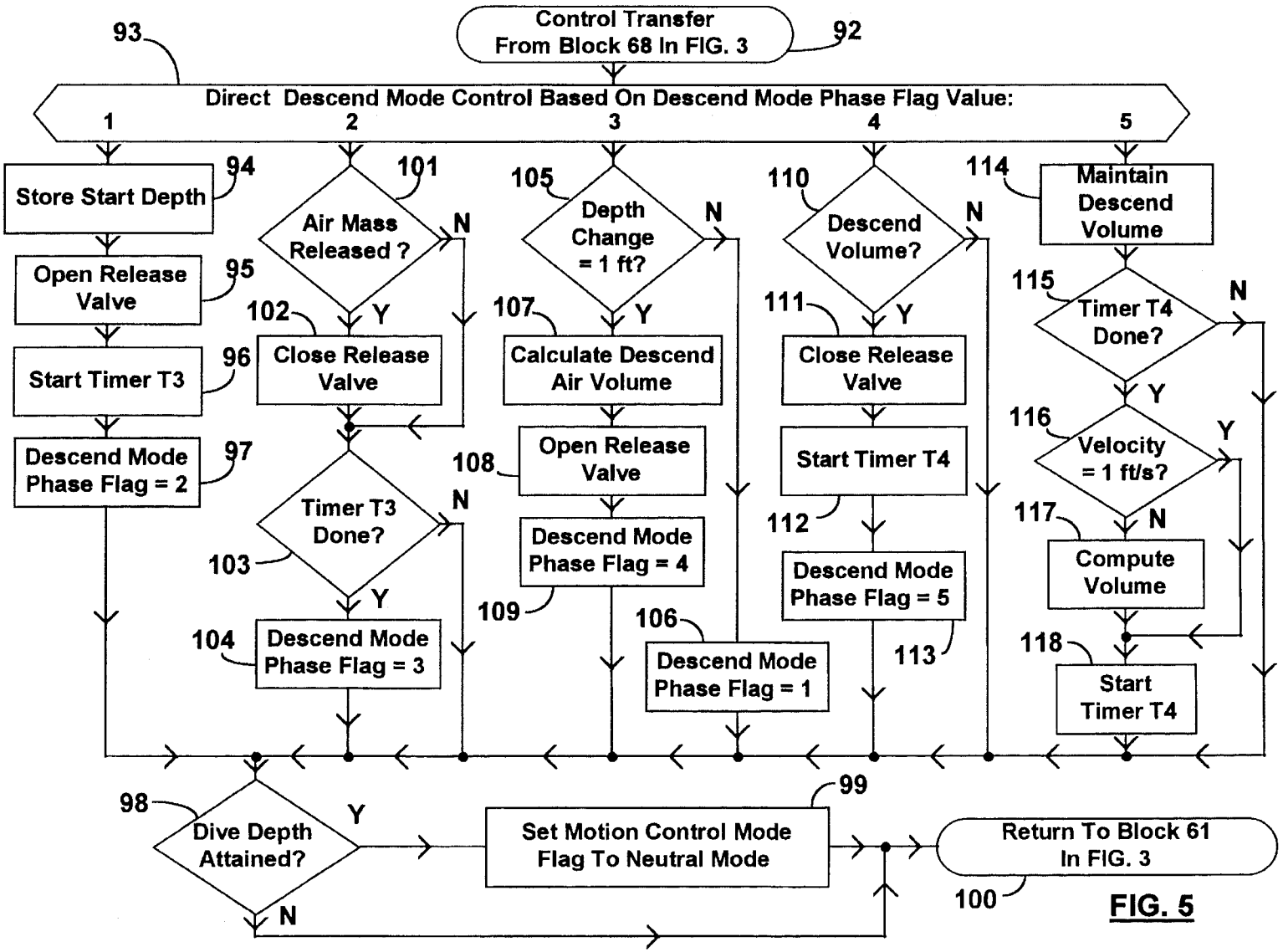
FIG. 5 is a flow chart representing a method of operation of the invention for automatic control of the vertical descent motion during a scuba dive.

Block 71 of FIG. 3 represents the descend mode of operation of the present invention and is shown in detail in FIG. 5. The descend mode module is structured to provide an automated transition, for the diver, from the surface or neutral modes of operation to a propelled descent. The descend mode module also uses proportional feedback to control the vertical velocity of the diver, with minimal overshoot and oscillation. These two functions of the descend mode control module will become apparent with the following description of operation.

Block 92 of FIG. 5 simply represents the transfer of processing control from block 68 in FIG. 3, when the motion control flag is set to descend mode. Block 93 transfers processing control to one of five different processing branches, on each pass through the descend mode control module 71, based on the descend mode phase flag value. When the descent mode phase flag value is set to 1, processing control branches to blocks 94, 95, 96, and 97. The descend mode phase flag value is set to 1 at block 60, and at block 67 when the diver selects descend mode.

Block 94 stores the current depth at the start of an air release cycle. Block 95 opens valve 40, to release air from bladder 28. Block 96 starts timer T3, which is set for 2 seconds and is used to determine when to test for vertical motion of the diver. Block 97 sets the descend mode phase flag to 2 so that on the next pass through the descend mode control module, processing will branch from block 93 to block 101. Processing control is transferred from block 97 to block 98.

Block 98 tests to determine if a predefined dive depth or the maximum dive depth is attained. These parameters are set prior to the dive, at block 60 in FIG. 3. If either of these depths are attained, processing control is transferred to block 99. Block 99 sets the motion control mode flag to neutral mode selection, which ends the operation of the descend mode. The processing flow then passes to block 100 which returns processing control to block 61 of FIG. 3.

Block 101 tests to determine if a predetermined volume of air was released from bladder 28 since valve 40 was opened at block 95. The volume of air to be released during each release cycle was determined at block 60 of FIG. 3 and is based on the divers weight. The time required to release the air from bladder 28 will be less than the duration of timer T3. If the predetermined volume of air was released from bladder 28, then release valve 40 is closed at block 102. Block 103 tests if timer T3, which was started at block 96, has finished. If timer T3 has finished, block 104 sets the descend mode phase flag to 3 and the next pass through the descend mode module, processing control will branch from block 93 to block 105.

Block 105 tests to determine if a change in the diver's depth of at least 1 foot occurred since the starting depth was recorded at block 94. If the depth of the diver did not change by at least 1 foot, then control is transferred to block 106. Block 106 sets the descend mode phase flag to 1 so that on the next pass through the descend control module, a new air release cycle will begin. If the diver's depth changed by at least 1 foot, then control branches from block 105 to block 107.

At block 107 an estimate of the required air volume in bladder 28 is computed to provide the diver with a constant descent rate of 1 foot per second. Tile air volume estimate is based on the diver's weight, the water density, and the water viscosity which are initialized at block 60 in FIG. 3. The air volume estimate is also based on the current volume of bladder 28. The equation used to calculate the required air volume was derived from the conventional first order linear differential equation which represents the motion of an object subject to a frictional force that is proportional to the object's velocity. Block 108 opens release valve 40 to begin the release of air to attain the air volume estimate from block 107. Block 109 sets the descend mode phase flag to 4 so that on the next pass through the descend control module, processing control is transferred from block 93 to block 110.

Block 110 tests if the volume of air, determined from block 107, is attained. When the descend volume is reached, block 111 closes release valve 40. Block 112 starts timer T4, which has a duration of 4 seconds. Timer T4 is used to time the intervals between adjustments in the descend air volume estimate for bladder 28. Block 113 sets the descend mode phase flag to 5 so that on the next pass through the descend control module, processing control is transferred from block 93 to block 114.

Figure 5A:
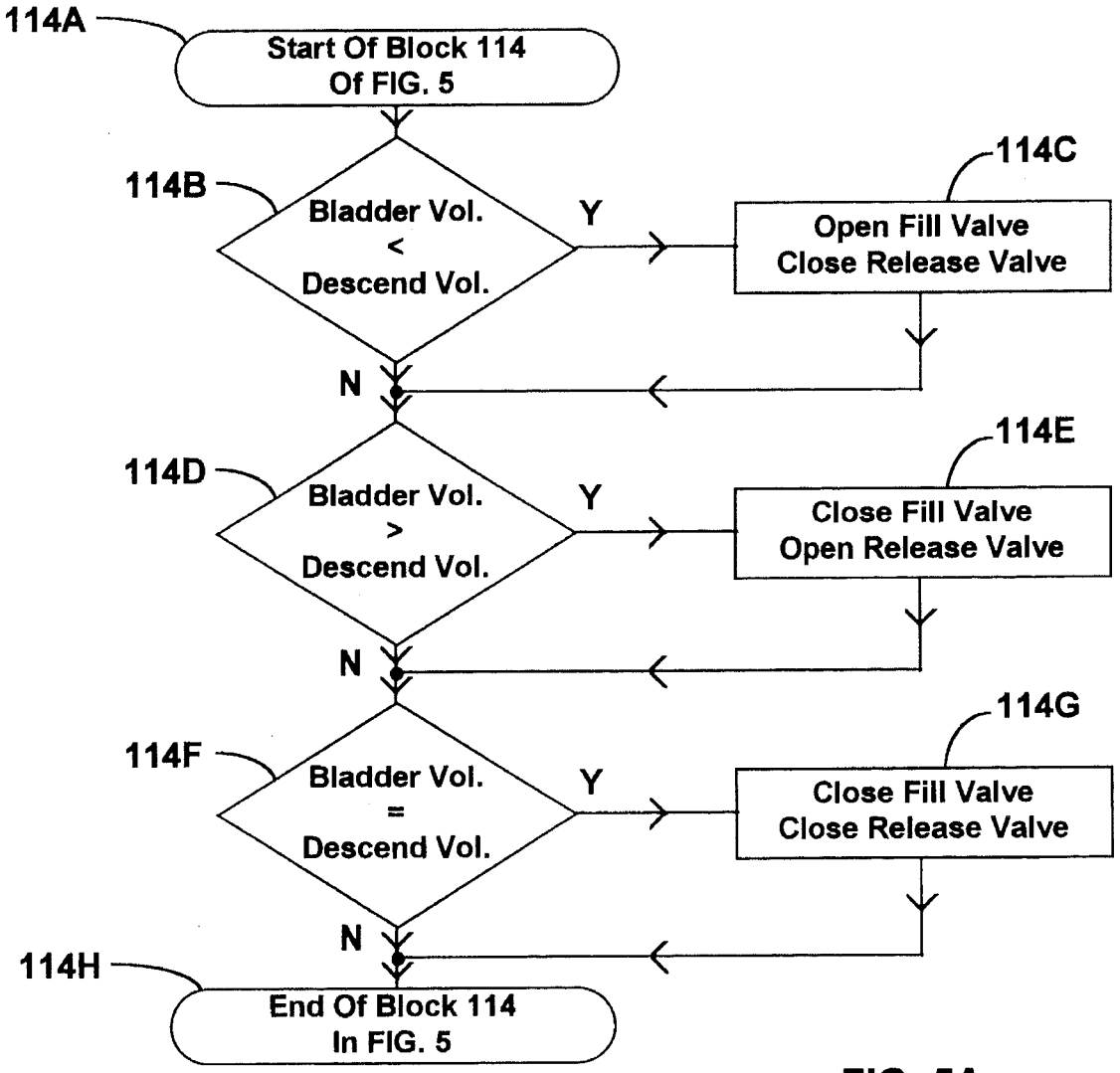
FIG. 5A is a flow chart representing the logic used by the invention to maintain the air displacement volume during the vertical descent of a scuba diver.

Block 114 maintains the air volume in bladder 28 to the desired descend air volume value calculated by block 107 or block 117. The processing at block 114 opens and closes valves 35 and 40 to maintain the volume of air in bladder 28. FIG. 5A expands block 114 to illustrate the process used to select the states of valves 35 and 40. Block 114A and Block 114H represent the entrance and exit to function block 114. Block 114B compares the estimate of the volume of air in bladder 28 with the desired descend air volume value. If the volume of air is less than the desired descend air volume value then block 114C opens fill valve 35 and closes release valve 40. Block 114D compares the two volumes and if the volume of air in bladder 28 is greater than the desired volume than block 114E closes fill valve 35 and opens release valve 40. Block 114F compares the two volumes and if the volume of air in bladder 28 is approximately equal to the desired volume than block 114G closes fill valve 35 and release valve 40.

Block 115 checks for timer T4 completion. If timer T4 is done, processing control passes to block 116 which checks if the current descent rate of the diver is within a predetermined tolerance of the desired velocity. If vertical velocity is not within tolerance, then a new air volume estimate is computed at block 117. The new air volume estimate is the sum the old air volume estimate, an air volume delta based on the magnitude and sign of the velocity deviation, and the air volume delta estimated by block 66. The air volume delta from block 66 compensates for the change in the diver's buoyancy due to the compression of the diver's exposure suit with depth and the consumption of air from the diver's air tank. Block 118 starts timer T4 to determine the next velocity estimate computation.

Figure 6:
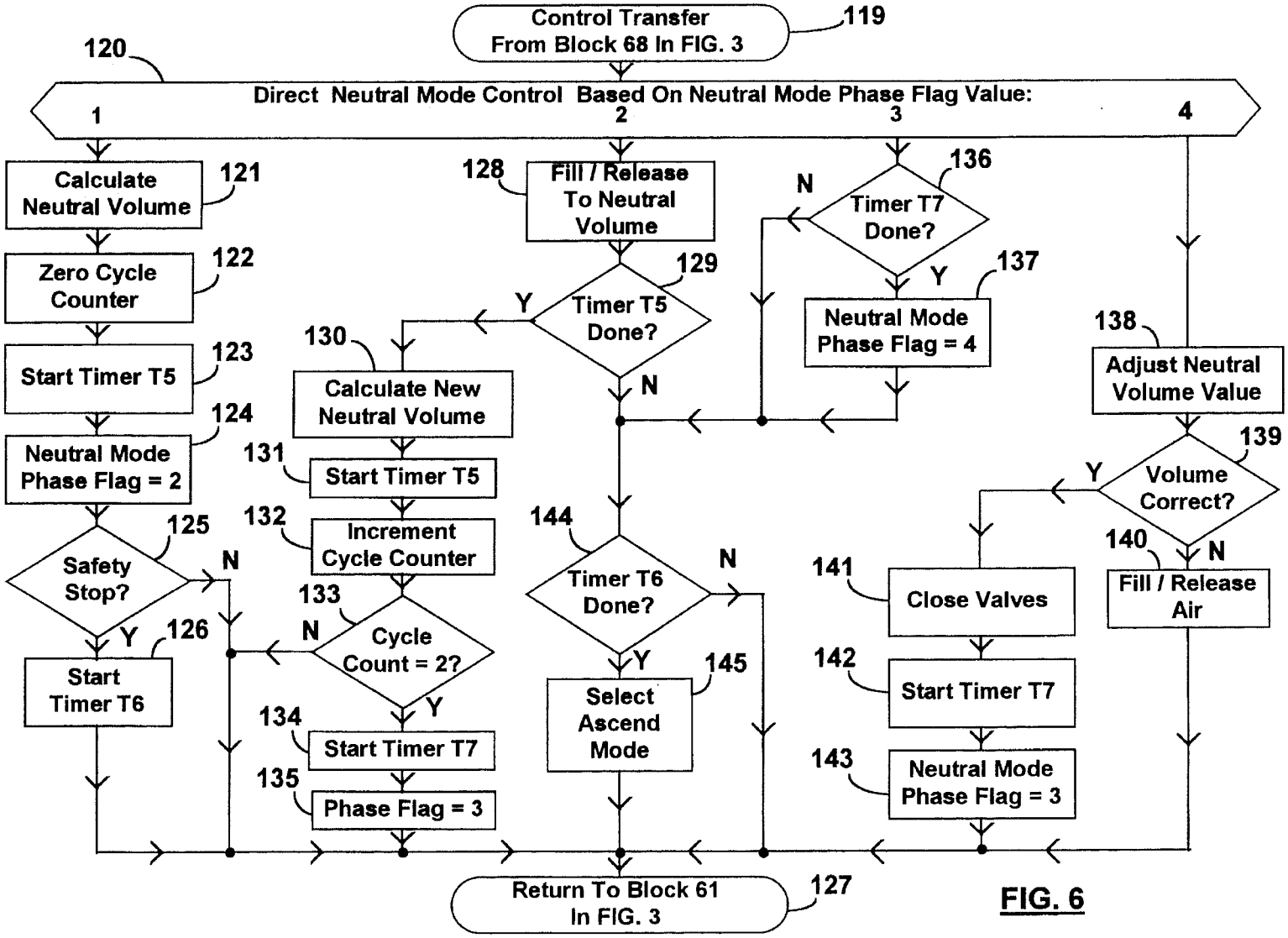
FIG. 6 is a flow chart representing a method of operation of the invention to achieve and maintain neutral buoyancy during a scuba dive.

Block 72 of FIG. 3 represents the neutral mode of operation of the present invention and is shown in detail in FIG. 6. The neutral mode module is structured to provide a transition from the descend or ascend modes of operation to the neutral mode of operation by bringing the diver to a stop, with minimal overshoot and oscillation in vertical velocity. The neutral mode control module also adjusts the volume of air in bladder 28 to maintain a state of neutral buoyancy. These functions of the neutral mode control module will become apparent with the following description of operation.

Figure 7:
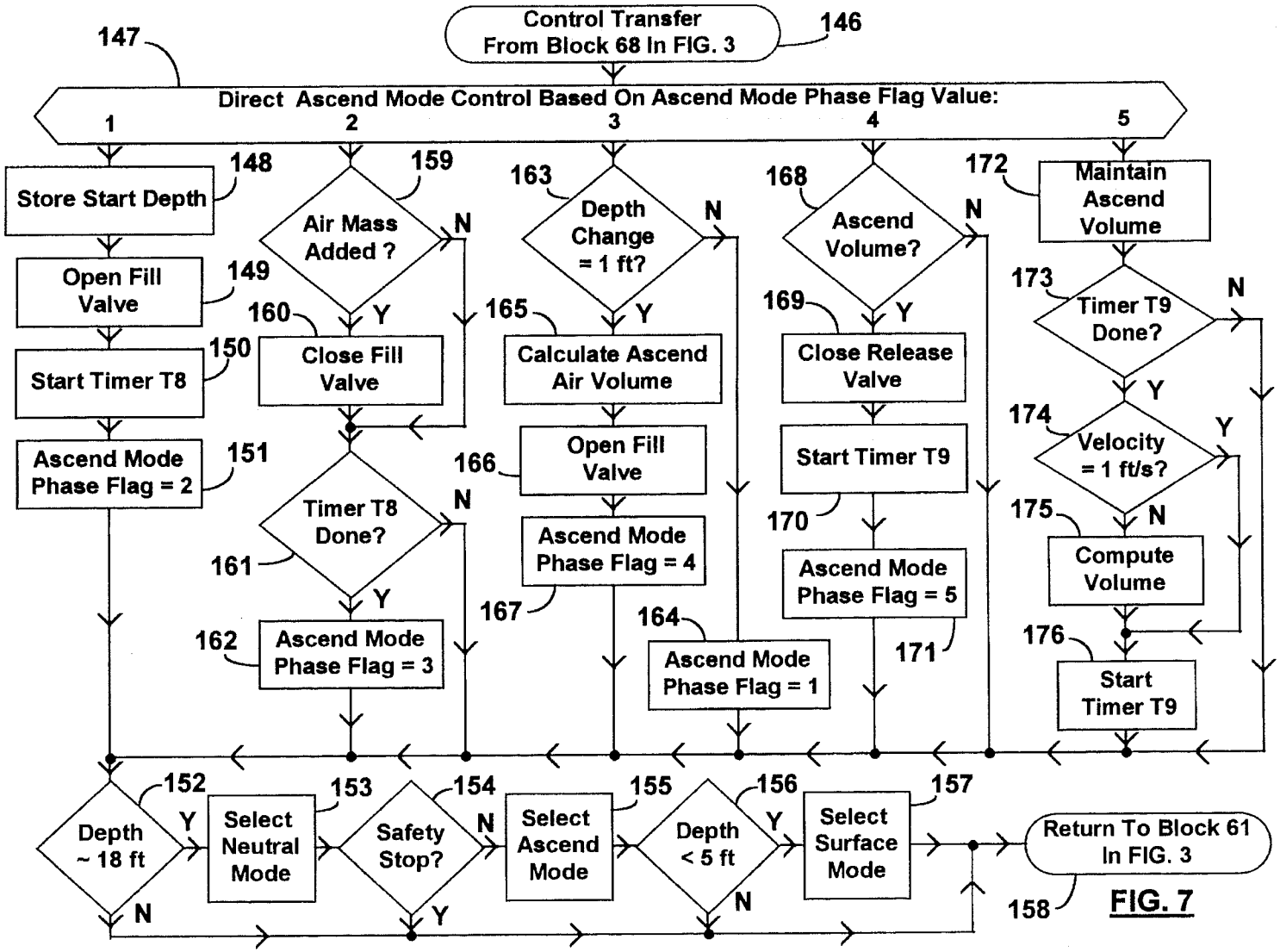
FIG. 7 is a flow chart representing a method of operation of the invention for automatic control over the vertical ascent motion during a scuba dive.

Block 119 of FIG. 6 simply represents the transfer of processing control from block 68 in FIG. 3, when the motion control mode flag is set to neutral mode. Block 120 transfers processing control to one of four different processing branches, on each pass through the neutral mode control module block 72, based on the neutral mode phase flag value. The neutral mode phase flag value is set to 1 in block 60 in FIG. 3 at initialization, in block 67 of FIG. 3 after the diver manually selects neutral mode, and in blocks 99 (FIG. 5) and 153 (FIG. 7). When the phase flag value is set to 1, control branches to block 121.

Block 121 calculates an estimate of the volume of air in bladder 28 required for neutral buoyancy. The computation in block 121 uses diver weight and water viscosity parameters from block 60, vertical velocity and acceleration data from block 64, the air volume estimate from block 65, and the compensation volume from block 66. The equation used to calculate the required air volume was derived from the conventional first order linear differential equation which represents the motion of an object subject to a frictional force that is proportional to the object's velocity. Block 122 initializes a calibration cycle counter that is used to tally the neutral buoyancy calibration cycles. Block 123 starts timer T5 which is a 10 second timer used to define the duration of the calibration cycle. Block 124 sets the neutral mode phase flag to 2 so that on the next pass through the neutral mode control module, processing will branch from block 120 to block 128.

Block 125 tests to see if the safety stop flag is set to determine if this entrance into the neutral mode control module is for a safety stop following an ascent, and if so, transfers control to block 126. The safety stop flag is set at block 64 and is based on recreational dive table data, elapsed dive time, and the diver's depth profile. Block 126 starts timer T6 with a duration of 3.5 minutes The processing flow then passes to block 127 which returns control to block 61 of FIG. 3.

Block 128 adjusts the volume of air in bladder 28 to equal the latest computed air volume required for neutral buoyancy. This is accomplished by using the difference in the current air volume and the estimated neutral buoyancy air volume to set the open and closed states of valves 35 and 40. Block 128 is executed multiple times during each calibration cycle.

Block 129 checks if timer T5 is done. If timer T5 is done, processing control passes to block 130. Block 130 calculates a new estimate for the neutral buoyancy air volume in bladder 28. Block 130 uses the same information and formulas as block 121. Block 131 starts timer T5 for another calibration cycle. Block 132 increments the calibration cycle counter used to tally the calibration cycles.

Block 133 tests to determine if a total of three calibration cycles were completed, and if so, processing control is branched to block 134. With the neutral mode calibration complete, block 134 starts timer T7 which has a duration of 15 seconds. Block 135 sets the neutral mode phase flag to 3 so that on the next pass through the neutral mode control module, processing will branch, from block 120 to block 136.

Block 136 checks for the completion of timer T7. If timer T7 is complete, processing control branches to block 137 which sets the neutral mode phase flag to 4 so that on the next pass through the neutral mode control module, processing will branch from block 120 to block 138.

Block 138 adjusts the neutral air volume value, if necessary, based on the change in the diver's exposure suit compression and the consumption of air in the diver's air tank computed in block 66 in FIG. 3. Block 139 compares the current air volume in bladder 28 to the neutral air volume value. If the air volume in bladder 28 is not within an acceptable tolerance of the neutral air volume value, then processing branches to block 140. Block 140 changes the air volume in bladder 28 by changing the open and closed states of valves 35 and 40. The process used by block 140 to select the states of valves 35 and 40 is the same as implemented in block 114 for maintaining the descend air volume. When the air volume in bladder 28 is within the acceptable tolerance of the neutral volume value, then block 139 transfers control to block 141.

Block 141 ensures that valves 35 and 40 are closed. Block 142 starts timer T7 for another 15 second interval before the next neutral volume adjustment. Block 143 sets the neutral mode phase flag to 3 so that on the next pass through the neutral mode control module, processing will branch from block 120 to block 136.

Block 144 provides a test to determine if timer T6 has expired, that is, if it was started at block 126. If timer T6 has expired, then the safety stop is complete, and processing control branches to block 145. Block 145 sets the motion control anode flag to ascend mode to initiate the final ascent from the dive.

Block 73 of FIG. 3 represents the ascend mode of operation of the present invention and is shown in detail in FIG. 7. The ascend mode module is structured to provide an automated transition, for the diver, from the neutral mode of operation to a propelled ascent. The ascend mode module provides processing control to support the transition from ascend mode to neutral mode for a safety stop at a depth of 15 feet. The ascend mode module provides processing control to support the transition from ascend mode to surface mode when the diver reaches a depth of 5 feet. The ascend mode module also cases proportional feedback to control the vertical velocity of the diver, with minimal overshoot and oscillation. These functions of the ascend mode control module will become apparent with the following description of operation.

Block 146 of FIG. 7 represents the transfer of processing control from block 68 in FIG. 3, when the motion control mode flag is set to ascend mode. Block 147 transfers processing control to one of five different processing branches on each pass through the ascend mode control module block 73, based on the ascend mode phase flag value. When the ascend mode phase flag value is set to 1, processing control branches from block 147 to block 148. The ascend mode phase flag value is set to 1 at block 60, at block 67 when the diver selects ascend mode, and at block 145 when a safety stop is completed.

Block 148 stores the current depth at the start of an air fill cycle. Block 149 opens fill valve 35, to add air to bladder 28. Block 150 starts timer T8 which is set for 2 seconds and is cased to determine when to test for vertical motion of the diver. Block 151 sets the ascend mode phase flag to 2 so that on the next pass through the ascend mode control module 73, processing will branch from block 147 to block 159.

A series of tests are conducted, starting at block 152, to determine if the ascend mode of operation should transition to neutral or surface operation modes. Block 152 checks if the diver's depth is within 0.5 feet of 18 feet. If it is, processing control is branched to block 153 which then sets the motion control mode flag to neutral mode. Block 154 tests if the safety stop flag is set. The safety stop flag is set at block 64 of FIG. 3 and is based on recreational dive table data, elapsed dive time, and the diver's depth profile. If no safety stop is required, block 155 sets the motion control mode flag back to ascend mode. Block 156 checks if the diver's depth is less than 5 feet, and if so, branches processing control to block 157. Block 157 sets the motion control flag to surface mode to transition from ascend mode to surface mode. Block 158 returns processing control to block 61 of FIG. 3.

Block 159 tests to determine if a predetermined volume of air was added to bladder 28 since fill valve 35 was opened at block 149. The volume of air to be added during each fill cycle was determined at block 60 of FIG. 3 and is based on the divers weight. The time required to add the air to bladder 28 will be less than the duration of timer T8. If the predetermined volume of air was added to bladder 28, then fill valve 35 is closed at block 160. Block 161 tests if timer T8, which was started at block 150, has finished. If timer T8 is done, block 162 sets the ascend mode phase flag to 3 and the next pass through the ascend mode module, processing control will branch from block 147 to block 163.

Block 163 tests to determine if a change in the diver's depth of at least 1 foot occurred since the starting depth was recorded at block 148. If the depth of the diver did not change by at least 1 foot, then processing control is transferred to block 164. Block 164 sets the ascend mode control phase flag to 1 so that on the next pass through the ascend control module 73, a new air release cycle will begin at block 148. If the diver's depth changed by at least 1 foot, then processing control branches from block 163 to block 165.

At block 165 an estimate of the required air volume in bladder 28 is computed to provide the diver with a constant ascent rate of 1 foot per second. The air volume estimate is based on the diver's weight, the water density, and the water viscosity which are initialized at block 60 in FIG. 3. The air volume estimate is also based on the current volume of bladder 28. The equation used to calculate the required air volume was derived from the conventional first order linear differential equation which represents the motion of an object subject to a frictional force that is proportional to the object's velocity. Block 166 opens fill valve 35 to begin the adding of air to attain the air volume estimate from block 165. Block 167 sets the ascend mode phase flag to 4 so that on the next pass through the ascend control module, block 147 branches to block 168.

Block 168 tests if the volume of air, determined from block 165 was attained. When the ascend volume is reached, block 169 closes fill valve 35. Block 170 starts timer T9, which has a duration of 2 seconds. Timer T9 is used to time the intervals between adjustments in the ascend air volume estimate for bladder 28. Block 171 sets the ascend mode phase flag to 5 so that on the next pass through the ascend control module, processing control is transferred from block 147 to block 172.

Block 172 maintains the air volume in bladder 28 to the latest value calculated by block 165 or block 175. The processing at block 172 opens and closes valves 35 and 40 to maintain the volume of air in bladder 28. The process used by block 172 to select the states of valves 35 and 40 is the same as implemented in block 114 for maintaining the descend air volume.

Block 173 checks for timer T9 completion. If timer T9 is done, control passes to block 174 which checks if the current ascent rate of the diver is within a predetermined tolerance of the vertical velocity. If the ascent rate is not within tolerance, then a new air volume estimate is computed at block 175. The new air volume estimate is the sum the old air volume estimate, an air volume delta based on the magnitude and sign of the velocity deviation, and an air volume delta estimated by block 66. The air volume delta from block 66 compensates for the change in the diver's buoyancy due to the compression of the diver's exposure suit with depth and the consumption of air from the diver's air tank. Block 176 starts timer T9 to determine the next velocity estimate computation.

As can be seen by the above teachings, the present invention provides a buoyancy compensator that significantly reduces the effort required by the diver for buoyancy control. With respect to prior art, the present invention is a mechanically simple automatic buoyancy control device, that utilizes electronic control over the air volume in a flexible air bladder. The present invention automates the process of attaining and maintaining neutral buoyancy of the diver, allowing the diver to move freely both horizontally and vertically. Accurate neutral buoyancy control is accomplished by the inclusion of compensation for diver exposure suit compression and scuba tank air consumption. The present invention extends the usefulness of the buoyancy control device to provide automated vertical propulsion with vertical velocity control for descending and ascending in the aquatic environment, allowing the diver to concentrate on acclimatization, and minimizing diver exertion and possible decompression sickness. Also provided is an automated process for establishing adequate positive buoyancy at the surface prior to and following the dive, to further minimize diver exertion. An automated safety stop is included as a safety feature to further reduce the diver's risk of decompression sickness. Automated transitions are provided between different operational modes of the buoyancy compensator to minimize the need for the diver's immediate attention to accomplish the task. Descend mode will automatically transition to neutral mode at a predetermined depth. Ascend mode will automatically transition to neutral mode for a safety stop or to surface mode when the diver is near the surface of the water. Neutral mode will automatically transition to ascend mode at the completion of a safety stop. The diver can change the operation mode of the buoyancy compensator manually by the press of a button on the diver input/output panel. The requirement for the diver to accurately predict the diving weight required for optimum buoyancy control is relaxed since the bladder air volume is more accurately controlled by the use of computer controlled valves, rather than manually actuated or mechanically controlled valves utilized by prior art.

The embodiment of the invention, as just described, is the preferred embodiment because it should provide the most accurate vertical motion control for the scuba diver. There are other embodiments of the present invention however, that provide less accurate vertical motion control of the scuba diver but also reduce hardware complexity and cost of the implementation of the invention. For example, air flow meter 37 could be removed if the magnitude of the regulated pressure from the compressed air source (not shown) and the fill rate of air bladder 28 are fully characterized with respect to the air volume in bladder 28 and the hydrostatic pressure of the surrounding water. With this embodiment, the volume increase of the air bladder due to opening fill valve 35 would be estimated by computer 42 based on the length of time fill valve 35 was open, the sensed water pressure, the sensed air temperature, and a prior estimate of the volume of air in bladder 28. An embodiment of the invention with further reduction in hardware complexity could be achieved if the release rate of air from air bladder 28, when release valve 40 is open, is fully characterized in a similar manner as mentioned above for the fill rate. This embodiment would eliminate both air flow meters 37 and 38 and use characterization data in computer 42 to estimate the change in air volume in bladder 28 when fill valve 35 or release valve 40 is opened. Another embodiment of the present invention with further reduction in hardware complexity could be achieved by eliminating temperature sensor 55. The diver would then enter water temperature and air temperature data prior to the dive, and an algorithm would be implemented by computer 40 to approximate the temperature of the air in bladder 28. The specific process of operating the hardware of the present invention, as summarized by FIG. 3, can also be varied and still produce different embodiments of the present invention.

Obviously, many modifications and variations of the present invention are possible in light of the above teachings. It is, therefore, to be understood that within the scope of the following claims the invention may be practiced otherwise than as specifically described.

What is claimed is:

1. A buoyancy control apparatus for scuba divers, comprising a flexible displacement chamber exposed to the water and adapted to be carried by a diver;

a pressure measurement means to determine the depth of said diver;

an air measurement means which is used to estimate the mass of air in said displacement chamber;

an air valve means connected between said displacement chamber, a compressed air source, and an exhaust port, whereby said air valve means can be actuated to add air to said displacement chamber from said compressed air source and release air from said displacement chamber into the surrounding water;

an electronic computing means that uses data from said pressure measurement means, data from said air measurement means, and predefined information to determine the required change in air mass in said displacement chamber to attain a predefined buoyancy state of said diver; and an electronic control means that changes the air mass in said displacement chamber through the actuation of said air valve means to attain said predefined buoyancy state of said diver.

2. The buoyancy control apparatus of claim 1 wherein said air measurement means comprises a first air flow meter which provides an electrical output signal directly related to the measured air flow rate and which measures the flow of air from said compressed air source into said displacement chamber;

a second air flow meter which provides an electrical output signal directly related to the measured air flow rate and which measures the flow of air from said displacement chamber into the surrounding water; and an algorithm means, implemented by said electronic computing means, which uses said first air flow meter measurement data, said second air flow meter measurement, and said pressure measurement means data to track the total air mass in said displacement chamber.

3. The buoyancy control apparatus of claim 1 wherein said air measurement means comprises a first algorithm means, implemented by said electronic computing means, which estimates the air mass added to said displacement chamber from said compressed air source and uses pressure data from said pressure measurement means and the length of time said air valve means was actuated to add air to said displacement chamber;

an air flow meter which provides an electrical output signal directly related to the measured air flow rate and which measures the flow of air from said displacement chamber into the surrounding water; and a second algorithm means, implemented by said electronic computing means, which uses estimates from said first algorithm means, measurement data from said air flow meter, and said pressure measurement means data to track the total air mass in said displacement chamber.

4. The buoyancy control apparatus of claim 1 wherein said air measurement means comprises a first algorithm means, implemented by said electronic computing means, which estimates the air mass added to said displacement chamber from said compressed air source and uses pressure data from said pressure measurement means and the length of time said air valve means was actuated to add air to said displacement chamber;

a second algorithm means, implemented by said electronic computing means, which estimates the air mass released from said displacement chamber into the surrounding water and uses pressure data from said pressure measurement means and the length of time said air valve means was actuated to release air from said displacement chamber; and a third algorithm means, implemented by said electronic computing means, which uses estimates from said first algorithm means and said second algorithm means to track the total air mass in said displacement chamber.

5. The buoyancy control apparatus of claim 1 wherein said air valve means comprises a first electronically controlled 2 way valve connected between said compressed air source and said displacement chamber; and a second electronically controlled 2 way valve connected between said displacement chamber and said exhaust port.

6. The buoyancy control apparatus of claim 1 wherein said electronic computing means is an embedded digital computer.

7. A method to maintain an established neutral buoyancy state of a diver, the method comprising:

acquiring sequential pressure measurements, using a pressure measurement means, to identify a pressure change, which occurs when said diver changes depth;

maintaining an estimate of air mass in an expandable displacement chamber, which is exposed to the water and attached to said diver;

maintaining an estimate of temperature of the air in said displacement chamber;

computing the change in air volume in said displacement chamber caused by the change in depth of said diver, by using said pressure measurements, the air mass estimate and the air temperature estimate of the air in said displacement chamber; and adjusting said air volume in said displacement chamber, using a gas valve means to add air to said displacement chamber or release air from said displacement chamber, to attain a neutral buoyancy air volume, whereby said neutral buoyancy state of said diver is maintained.

8. The method of claim 7 further including an exposure suit buoyancy compensation method which uses predefined buoyancy data on an exposure suit to compensate for the change in buoyancy of said exposure suit to modify said neutral buoyancy air volume value.

9. The method of claim 7 further including a method to compensate for the change of buoyancy of the scuba diver's air tank as air is consumed and uses predefined air consumption data of said scuba diver and depth profile data recorded from the dive to modify said neutral buoyancy air volume value.

10. A method to provide vertical motion control for a diver, the method comprising:

acquiring sequential pressure measurements, using a pressure measurement means, to determine the rate of change in pressure of the surrounding water as said diver moves vertically;

maintaining an estimate of air mass in a flexible displacement chamber, which is exposed to the water and attached to said diver;

maintaining an estimate of temperature of the air in said displacement chamber;

using said rate of change in pressure of the surrounding water to compute said diver's vertical velocity;

comparing the difference between the vertical velocity of said diver and a predefined vertical velocity;

using the pressure measurement data, the air mass estimate, the temperature estimate, and the vertical velocity comparison to compute a new air volume in said displacement chamber which will reduce the velocity difference between the vertical velocity of said diver and said predefined vertical velocity; and adjusting the air volume in said displacement chamber, using a gas valve means to add air to said displacement chamber or release air from said displacement chamber, to attain said new air volume, whereby said velocity difference is reduced.

11. The method of claim 10 including a method to stop said diver's vertical motion by setting said predefined vertical velocity to zero.

12. The method of claim 10 including a method to start said diver's vertical motion, from a stop, by setting said predefined vertical velocity to a non zero value.

* * * * *

UNITED STATES PATENT AND TRADEMARK OFFICE

CERTIFICATE OF CORRECTION

PATENT NO. : 5,496,136
DATED : March 5, 1996
INVENTOR(S) : Mark P. Egan

It is certified that error appears in the above-indentified patent and that said Letters Patent is hereby corrected as shown below:

Column 1, line 23, change 'Tile' to 'The.'

Column 2, line 40, remove semicolon.

Column 2, line 49, change 'Thee' to 'The.'

Column 4, line 26, change 'Tills' to 'This.'

Column 5, line 63, change 'Tile' to 'The.'

Column 7, line 35, change 'Tile' to 'The.'

Column 12, line 42, change 'Tile' to 'The.'

Column 15, line 8, change 'cases' to 'uses.'

Column 15, line 27, change 'cased' to 'used.'

Signed and Sealed this

Twenty-fifth Day of June, 1996

*Attest:*

Bruce Lehman

BRUCE LEHMAN

*Attesting Officer*

*Commissioner of Patents and Trademarks*